US008104920B2

(12) United States Patent
Dubord

(10) Patent No.: US 8,104,920 B2
(45) Date of Patent: Jan. 31, 2012

(54) ADJUSTABLE MODULAR LIGHTING SYSTEM AND METHOD OF USING SAME

(76) Inventor: Jack Dubord, Escondido, CA (US)

( * ) Notice: Subject to any disclaimer, the term of this patent is extended or adjusted under 35 U.S.C. 154(b) by 718 days.

(21) Appl. No.: 12/261,754

(22) Filed: Oct. 30, 2008

(65) Prior Publication Data

US 2009/0296381 A1 Dec. 3, 2009

Related U.S. Application Data

(60) Provisional application No. 61/057,857, filed on Jun. 1, 2008.

(51) Int. Cl.
*F21V 21/00* (2006.01)

(52) U.S. Cl. ..... 362/217.12; 362/217.13; 362/217.17; 362/225; 362/249.02; 362/285; 362/311.02; 362/368

(58) Field of Classification Search ..... 362/217.11, 362/217.12, 217.13, 217.17, 219, 225, 249.02, 362/285, 311.02, 368
See application file for complete search history.

(56) References Cited

U.S. PATENT DOCUMENTS 3,840,842 A * 10/1974 Gabryelewicz ..... 439/639
5,607,227 A 3/1997 Yasumoto et al.
5,957,568 A 9/1999 Byers
6,283,612 B1 9/2001 Hunter
6,472,823 B2 10/2002 Yen
6,659,622 B2 12/2003 Katogi et al.
6,665,170 B1 12/2003 Warner et al.
7,244,058 B2 * 7/2007 DiPenti et al. ..... 362/547
7,267,461 B2 * 9/2007 Kan et al. ..... 362/373
7,331,689 B2 * 2/2008 Chen ..... 362/240
7,347,606 B1 3/2008 Patten
7,572,027 B2 * 8/2009 Zampini et al. ..... 362/225
7,926,985 B2 * 4/2011 Teng et al. ..... 362/373
2007/0274067 A1 * 11/2007 Sloan et al. ..... 362/219
2010/0271804 A1 * 10/2010 Levine ..... 362/35

* cited by examiner

*Primary Examiner* — Jong-Suk (James) Lee
*Assistant Examiner* — Tsion Tumebo
(74) *Attorney, Agent, or Firm* — Jerry R. Potts

(57) ABSTRACT

A modular lighting system includes an elongate light module with a printed circuit board having at least one light emitting diode mounted thereon for emitting a shadowless light pattern. The light module is adapted to be electrically connected to one or more other light modules where each light module generally includes a support frame having a base member disposed between an upstanding right-side wall member and an upstanding left-side wall member. Each side wall member includes an upper inner wall channel, a lower inner wall channel and an outer wall channel which is disposed between the upper inner wall channel and the lower inner wall channel. The channels support a track cover and in cooperation with a pair of spaced apart removable retention members help determine, at time of installation, the mounting angle of the printed circuit board for directing light emitting from the light module.

13 Claims, 9 Drawing Sheets

ADJUSTABLE MODULAR LIGHTING SYSTEM AND METHOD OF USING SAME

CROSS-REFERENCE TO RELATED APPLICATIONS

This application is a non provisional continuation-in-part utility patent application of provisional application Ser. No. 61/057,857 entitled "LED ADJUSTABLE BEAM DIRECTION TRACK LIGHTING SYSTEM," filed on Jun. 1, 2008.

STATEMENT REGARDING FEDERALLY SPONSORED RESEARCH OR DEVELOPMENT

Not Applicable

REFERENCE TO A "MICROFICHE APPENDIX"

Not Applicable

BACKGROUND OF THE INVENTION

The present invention is related to a means and process for casting visible radiant energy in at least one direction to render objects in that direction visible and more particularly, is related to a modular lighting system for creating lighting patterns on an object to be illuminated.

SUMMARY OF THE INVENTION

A modular lighting system includes an adjustable elongate light module with a printed circuit board having at least one light emitting diode mounted thereon for emitting a shadowless light pattern. The light module is adapted to be electrically connected to one or more other light modules where each light module generally includes a support frame having a base member disposed between an upstanding right-side wall member and an upstanding left-side wall member. Each side wall member includes an upper inner wall channel, a lower inner wall channel and an outer wall channel which is disposed between the upper inner wall channel and the lower inner wall channel. The outer wall channels support a track cover while the inner wall channels in cooperation with a pair of spaced apart removable retention members help determine, at time of installation, the mounting angle of the printed circuit board for directing light emitting from the light module.

In another preferred embodiment of the present invention a modular lighting system generally includes an adjustable elongate light module having mounted therein a printed circuit board with light means mounted thereon for emitting light in a specific light pattern. The elongate light module has a male connector and a female connector, which connectors facilitate electrically connecting the elongate light module to at least another elongate light module. The male connector and the female connector are further connected electrically to the light means so that it may create lighting patterns on an object to be illuminated. Each of the light modules includes a support frame that has a base member which is disposed between two upstanding side wall members that include a right-side wall member and a left-side wall member. Each side wall member includes an upper inner wall channel, a lower inner wall channel and an outer wall channel which is disposed between about the upper inner wall channel and the lower inner wall channel. Each side wall member further includes at about the upper inner wall channel an integrally connected retention member for facilitating the retention and the mounting angle of the light means relative to the base member of the support frame.

In still yet another preferred embodiment of the present invention an adjustable modular lighting system generally includes a module connector and a plurality of adjustable elongate light modules. Each individual elongate light module includes a support frame having a base member disposed between two upstanding side wall members including a right-side wall member and a left-side wall member. Each side wall member includes an upper inner wall channel, a lower inner wall channel and an outer wall channel disposed between the upper inner wall channel and the lower inner wall channel. Each side wall member further includes at about the upper inner wall channel an integrally connected retention member for facilitating the retention and mounting angle of light means for emitting light in a specific lighting pattern.

In a preferred method of installation, for customizing a lighting system includes the steps of: determining a specific number N of light modules needed to illuminate an object; coupling N number of light modules in a string array; wherein each individual light module includes: a support frame having a base member disposed between two upstanding side wall members including a right-side wall member and a left-side wall member; wherein each side wall member includes an upper inner wall channel, a lower inner wall channel and an outer wall channel disposed between said upper inner wall channel and said lower inner wall channel; and wherein each side wall member further includes at about said upper inner wall channel an integrally connected retention member for facilitating the retention and mounting angle of light means for emitting light in a specific lighting pattern; adjusting the mounting angle of the light means by performing one or more of the following steps as needed to create said specific lighting pattern: (a) aligning the light means between an upper inner wall channel and an opposing upper inner wall channel; (b) aligning the light means between a retention member and an opposing upper inner wall channel; (c) removing permanently a retention member from a light module and aligning the light means between an upper wall channel and an opposing lower inner wall channel; and (d) applying electrical current to an end light module to electrically activate said string array.

BRIEF DESCRIPTION OF DRAWINGS

The above mentioned features and steps of the invention and the manner of attaining them will become apparent, and the invention itself will be best understood by reference to the following description of the embodiments of the invention in conjunction with the accompanying drawings wherein.

DETAILED DESCRIPTION

Figure 1:
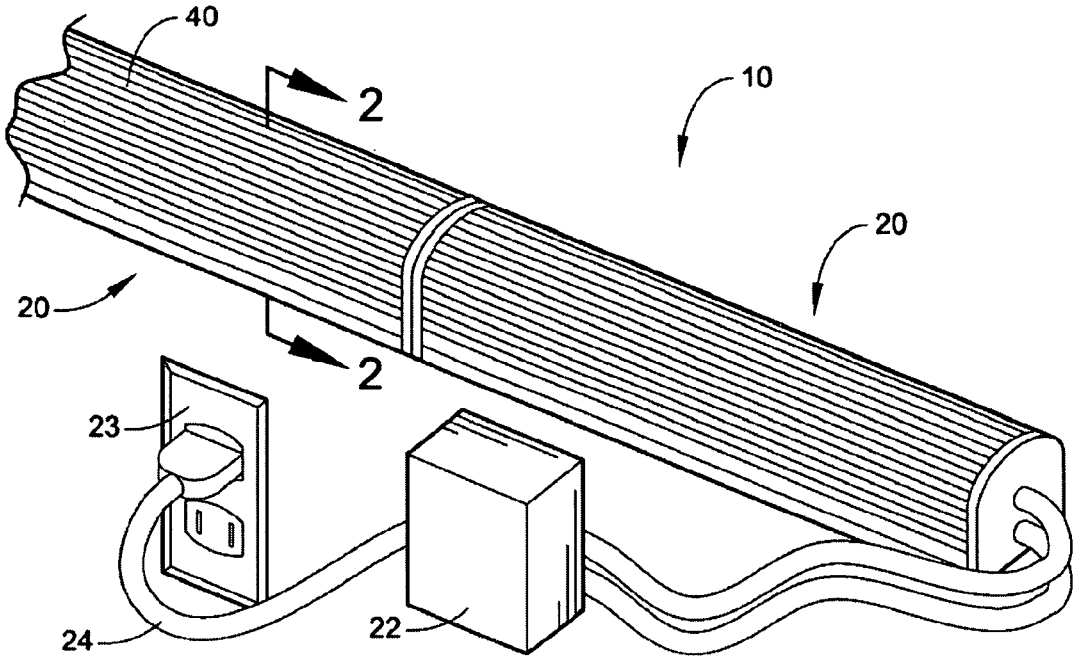
FIG. 1 is a perspective view of a customized strip lighting system which is constructed according to the present invention.

Referring now to the drawings and more particularly to FIG. 1 there is illustrated a customizable modular lighting system 10 which is constructed in accordance with a preferred embodiment of the present invention. The modular lighting system 10 is constructed to be easily configured for positioning light in a customized manner. The modular lighting system 10 casts visible radiant energy in at least one direction to render objects in that direction visible and more particularly it creates lighting patterns on an object to be illuminated.

The modular lighting system 10 is adjustable utilizing a low cost novel positioning system that allows a user or installer to quickly configure the lighting system to position light where needed. This new and improved modular lighting system 10 embodies the following features: (1) it is easy to install; (2) it is low cost; (3) it can be adjusted when lighting needs change; (4) it can be made in any length; (5) it can be configured to provide 360 degrees of lighting; (6) it can be adjusted after installation; and (7) it allows the user to adjust the direction of each modular lighting element in the system. Expected embodiments of this lighting system include, but are not limited to, under cabinet lighting, case lighting for consumer goods, sign lighting, museum lighting, indirect lighting of displayed items, artwork lighting, general room illumination, industrial task lighting for assembly work, warehousing, library cases, office cubicles, and any specialized light installation where the user needs to position the light in a compact and flexible customizing way at an installation site.

Figure 2:
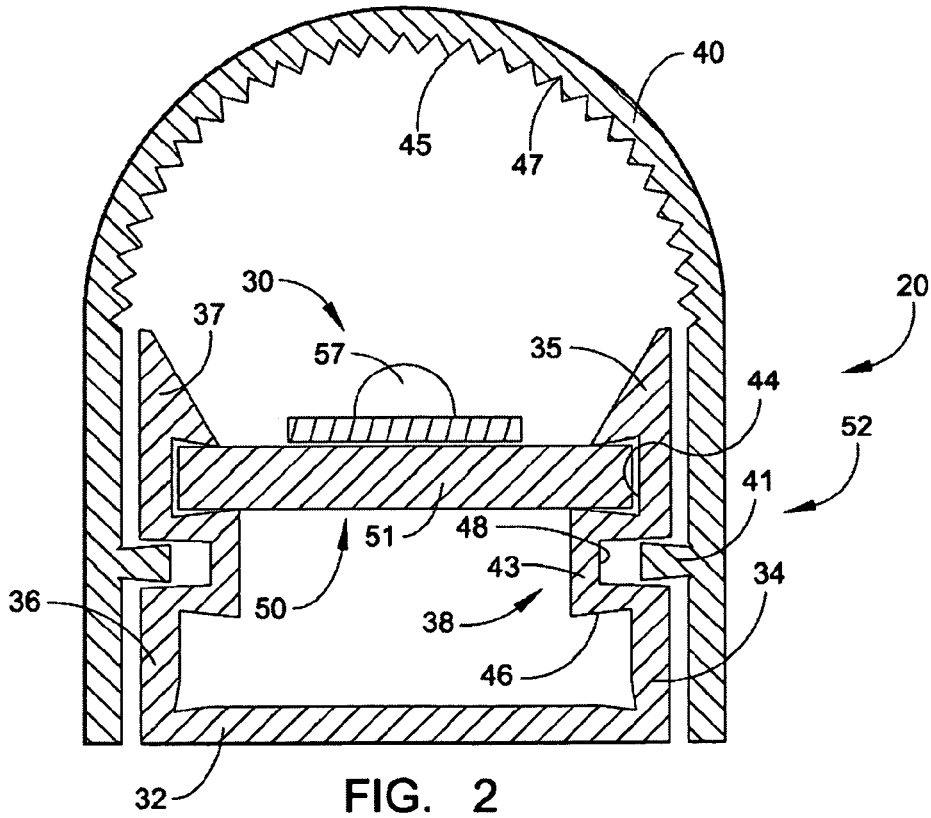
FIG. 2 is a cross sectional view taken substantially along line 2-2 of the strip lighting system of FIG. 1.
Figure 3:
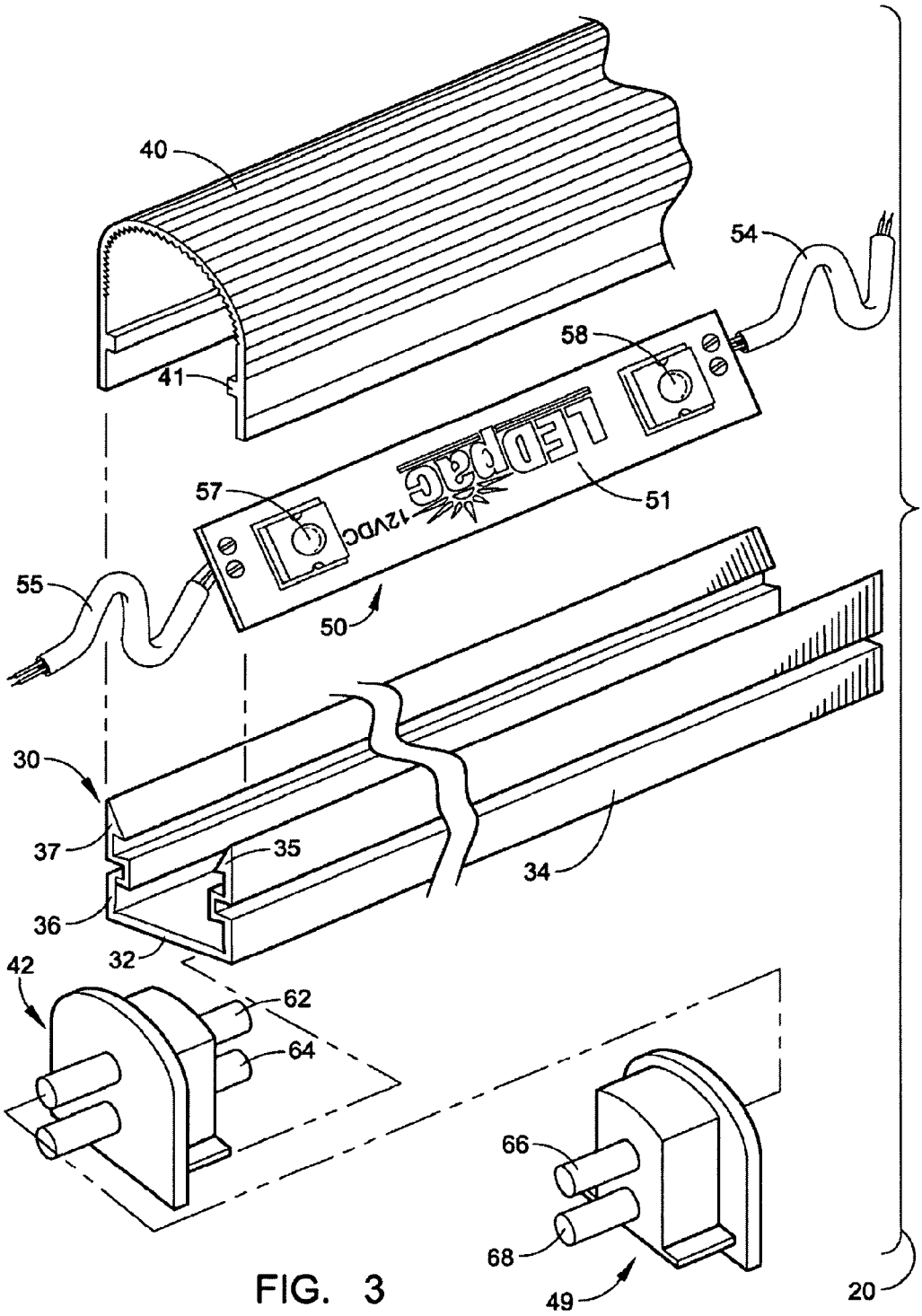
FIG. 3 is an exploded view of a light module forming part of the strip lighting system of FIG. 1.

Considering now the modular lighting system 10 in greater detail with reference to FIGS. 1-3, the modular lighting system 10 generally includes one or more customizable lighting modules, such as a lighting module 20 and an alternating current to direct current converter 22 which is adapted to be powered by an conventional electrical outlet, such as an electrical outlet 23, via a power cord 24. As will be explained hereinafter in greater detail, the individual light modules, such as the light module 20 are customizable in that its overall length may be chosen in the field for illuminating a specific surface area. In addition, the direction of the light emitting from the light module may be chosen in the field to illuminate a specific object area either perpendicular to the light module 20, or to a right area of the light module 20 or to a left area of the light module 20 as be necessary for each lighting task. In short then, the direction in which a given light module 20 cast visible radiant energy is a field selected direction so lighting may be customized for each installation.

Figure 11:
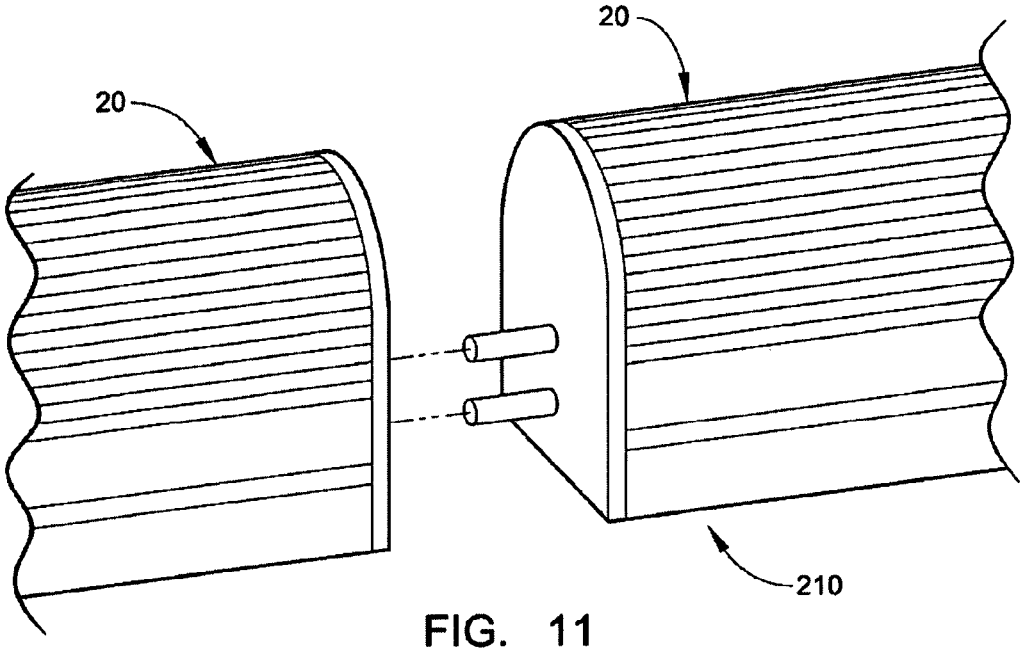
FIG. 11 is an end perspective view of the strip lighting system of FIG. 1, illustrating its male connecting pins.

Each lighting module 20, is adapted to be coupled electrically to a like lighting module 20 instead of to the converter 22. In this manner, power may be transferred directly from the converter 22 to a light module 20, or in the alternative, the power may be transferred from light module to light module by coupling the light modules in a string or linear arrangement as best seen in FIGS. 1 and 11. In any event, it should be noted that the direct current voltage generated by the converter 22 is sufficient for driving a plurality of the individual ones of the light modules 20 in a given modular lighting system 10 so that each lighting module 20 is able to cast visible radiant energy in at least one direction to render objects in that direction visible.

Although in this preferred embodiment of the present invention, the light modules are described as being powered from a conventional wall plug power system, it should be understood by those skilled in the art, that each light module may be powered by a battery power supply (not shown) since each light module operates using a direct current or dc voltage.

Considering now the adjustable light module 20 in greater detail with reference to FIGS. 1-3, the light module 20 generally includes an adjustable elongate support frame or rail 30, an elongate track cover 40, and an elongate rectangularly shaped printed circuit board assembly 50. Depending upon the length of the rail 30, the light module 20 may include a plurality of printed circuit board assemblies which are coupled together in a string array as needed for a given installation.

Figure 4:
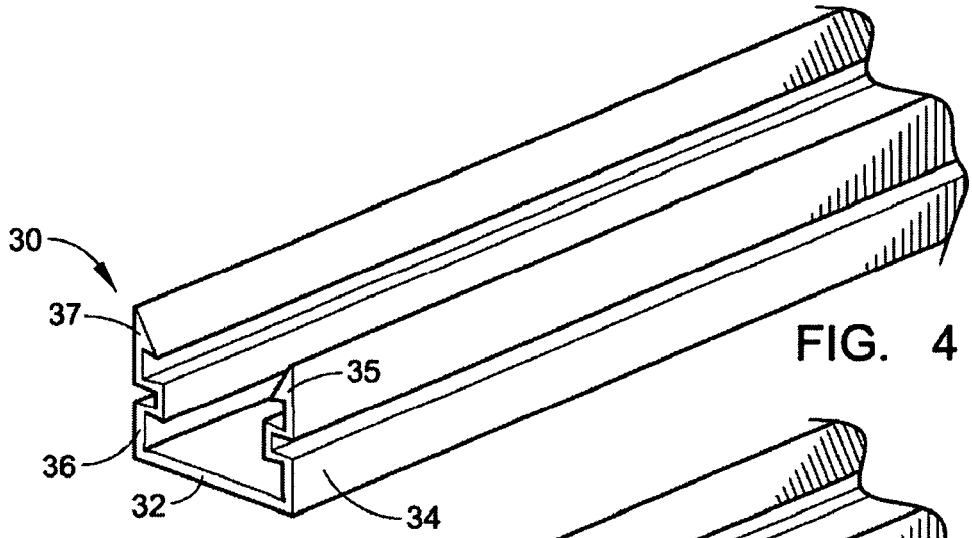
FIG. 4 is a perspective view of a support frame forming part of the light module of FIG. 3.

Considering now the support frame or rail 30 in greater detail with reference to FIGS. 2-4, The support rail 30 is a thin wall extruded plastic part with a wall thickness which is sufficiently thin so that it may be easily cut in the field at time of installation to a specific length of X meters. In this regard, the length of the rail 30 may be cut to a desired length to meet most if not all customized lighting system requirements. For example, the length of the light module 20 can be cut at a sufficient length so that only a single light module with a plurality of printed circuit board assemblies are needed to illuminate a given area. Alternatively, the light module 20 can be cut so that two or more light modules would be required to illuminate a given area such as previously mentioned for under cabinet lighting, case lighting for consumer goods, sign lighting, museum lighting, indirect lighting of displayed items, artwork lighting, general room illumination, industrial task lighting for assembly work, warehousing, library cases, office cubicles, and any specialized light installation where the user needs to position the light in a compact and flexible customizing way at the installation site.

Once the support frame 30 has been cut to its desired length, the proximal end and the distal ends are capped with end caps which include a male end cap connector 42 and a female end connector 49 which are adapted to be pushed into and supported by the support frame 30 in a friction tight manner. If further customization of the support frame 30 is required for field installation, the mounting of the male connector 42 and the female connector 49 may be delayed until such further modification has been achieved. In any event, each male connector 42 and each female connector 49 is provided with a set of plug-in connector pins, such as plug-in connector pins 62 and 64 and plug-in connector pins 66 and 68 respectively that permit the light module to be electrically coupled together or to an external power source as needed. Since the male connector 42 and the female connector have similar constructions their assembly into desired configuration end caps is easily achieved in the field for a given installation.

Considering now the rail 30 in still greater detail, the elongate rail 30 is generally U-shaped having a base member 32 and a pair of upstanding side wall members, including a right-side wall member 34 and a left-side wall member 36. The base member 32 is disposed between and integrally connected to the side wall members 34 and 36 respectively, which side walls extend perpendicularly upward from the base member 32 at about a ninety degree angle.

Each side wall member 34 and 36 is integrally connected at their respective distal ends to an inwardly slopped triangularly shaped retention member, such as a retention member 35 and a retention member 37 respectively. The side wall members 34 and 36 as well as their respective retention members 35 and 37 are the mirror image of one another and are spaced apart from one another a sufficient distance for supporting between them the elongate printed circuit board assembly 50 (FIG. 7) that will be described hereinafter in greater detail.

As the upstanding side wall members 34 and 36 and their respective retention members 35 and 37 are mirror images of one another only the right-side wall member 34 and its associated retention member 35 will be described hereinafter in greater detail. Referring now to FIGS. 2-5, the right-side wall member 34 generally includes an inside or interior wall portion or area indicated generally at 38 and an outside or exterior wall portion or area indicated generally at 52. The interior wall area 38 has disposed therein an upper inner wall channel 44 and a lower inner wall channel 46 which channels 44 and 46 are spaced apart from one another by an interior wall protuberance 43. The upper inner wall channel 44, the lower inner wall channel 46 and the interior wall protuberance 43, each extend along the entire longitudinal length of the interior inner wall 38. The bottom of the lower inner wall channel 46 terminates at the top surface of the base member 32, while the top of the lower inner wall channel 46 terminates at the bottom surface of the interior wall protuberance 43 as best seen in FIG. 2. In a similar manner, the top of the upper inner wall channel 44 terminates at the bottom surface the right-side retention member 35, while the bottom of the upper inner wall channel 44 terminates at the top surface of the interior wall protuberance 43. In summary then, the interior wall area has an in and out structure formed of channels and the protuberance.

This in and out wall structure of the right-side wall member 34 is an important feature of the present invention since it not only permits the end caps 42 and 49 respectively to be held within the support frame 30 in a friction tight manner, but this structure, as will be explained hereinafter in greater detail, also enables the printed circuit board assembly 50 to be oriented within the light module 20 in any one of several different orientations for facilitating the directing of light from the light module 20.

Considering now the outside or exterior wall 52 in greater detail, the exterior wall 52 has disposed therein an outer wall channel 48 which is disposed between the upper inner wall channel 44 and the lower inner wall channel 46 at about the interior wall protuberance 43. The outer wall channel 48 is dimensioned and shaped for receiving and capturing slidably therein a track cover nub or protuberance indicated generally at 41. The track cover nub 41 extends along the entire longitudinal length of the track cover 40 extending inwardly from the interior wall area of the track cover 40 a sufficient distance to be easily captured within the outer wall channel 48. In this manner the track cover 40 is slidably captured on the exterior wall 52 of the support rail 30 via the nubs 41.

Since the support frame or rail 30 has a thin wall construction, the retention member 35 integrally connected to the right-side wall member 34 at about the upper interior wall channel 44 may be easily temporarily pushed outwardly, under finger pressure by a user, to increase the spacing between the top retention walls 35 and 37 of the right-side wall member 34 and the left-side wall member 36 respectively to allow the printed circuit board assembly 50 to be slidably received within the upper inner wall channel 44 of the right-side wall member 34 and the upper inner wall channel of the left-side wall member 36. When this finger pressure is removed from the retention members 35 and 37 respectively, the printed circuit board assembly 50 is slidably captured within the upper inner wall channels and is mounted parallel to the base member 32 so that light radiating from the printed circuit board assembly 50 is channeled upwardly at about a ninety degree angle to the base member 32 through the track cover 40. This is sometimes called the straight light configuration.

Figure 7:
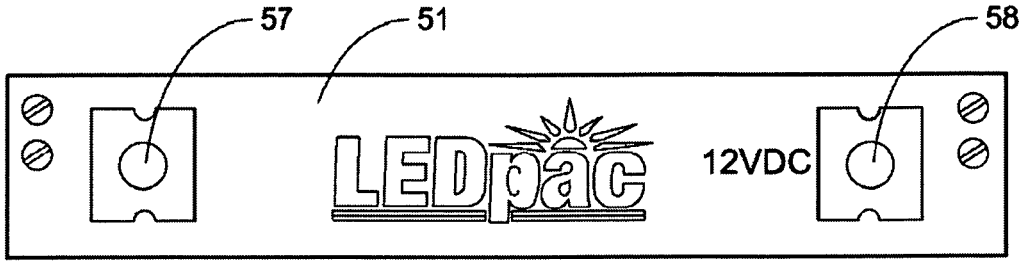
FIG. 7 is a top plane view of an LED mounted printed circuit board forming part of the light module of FIG. 3.
Figure 8:
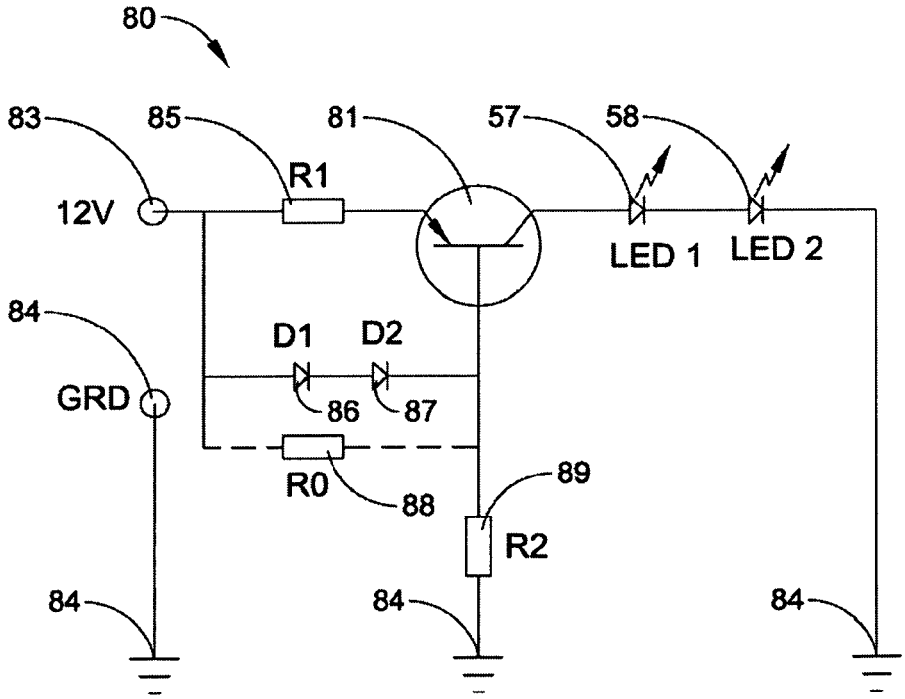
FIG. 8 is an electrical schematic of the LED mounted printed circuit board of FIG. 7.

Considering now the printed circuit board assembly 50 in greater detail with reference to FIGS. 3, and 7-8, the printed circuit board assembly 50 generally includes a printed circuit board 51 having mounted thereon a pair of spaced apart light emitting diodes, such as a light emitting diode 57 and a light emitting diode 58 respectively. The assembly 50 also includes a set of coupling wires, such as a coupling wire 54 and a coupling wire 55 each of which has a sufficient length to be extended to another printed circuit board assembly or to an end cap, such as a male end cap connector 42 or a female end cap connector 49 as may be necessary for installation purposes. Printed circuit board to printed circuit board connections are made by simple coupling means such as by solder connections or by a push on crimp. As will be explained hereinafter in greater detail, the printed circuit board 51 is rectangularly shaped and dimensioned to be mounted slidably onto an interior wall area of the rail 30 within the upper interior wall channels of the upstanding side walls 34 and 36 respectively.

Referring now to the electrical schematic in FIG. 8, a diode drive circuit 80 which is disposed on the printed circuit board 51 is illustrated. The electrical circuit 80 generally includes a transistor 81 whose emitter is coupled to a 12 volt input source pin 83 via a resistor 85 (R1). The collector of the transistor 81 is coupled to a ground pin 84 via the light emitting diode 57 and light emitting diode 58 which are connected in series with one another. The base of the transistor 81 is also coupled to the ground pin 84 via a resistor 89 (R2). The base of the transistor 81 is also coupled to the 12 volt input source pin via a set of series connected diodes including a diode 86 (D1) and a diode 87 (D2). An optional resistor indicated at 88 (R0) may be connected in parallel with the diodes 86 and 87 if needed. This drive circuit 80 for driving the light emitting diodes to an on state is an elementary circuit which could be easily constructed by one skilled in the art without any further explanation than has been provided herein.

Considering now the track cover 40 in greater detail with reference to FIG. 3, the track cover 40 is generally U-shaped and is dimensioned to snap on or over the support frame 30. The track cover 40 is an elongate extruded part (cut to length) and which has a series of spaced apart ridges and valleys, such as a ridge 45 and a valley 47, which function to create a light spread pattern. In this regard, the track cover 40 functions as a light distribution cover or a light modifier cover. The track cover 40 also encloses the printed circuit board assembly 50 within the support frame 30 so that the printed circuit board assembly 50 is also protected. Although in the preferred embodiment of the present invention the track cover 40 is described as having a general U-shape, it should be understood by those skilled in the art that the track cover can have any desired shape to cover the track or to modify the light in a particular manner.

Figure 9:
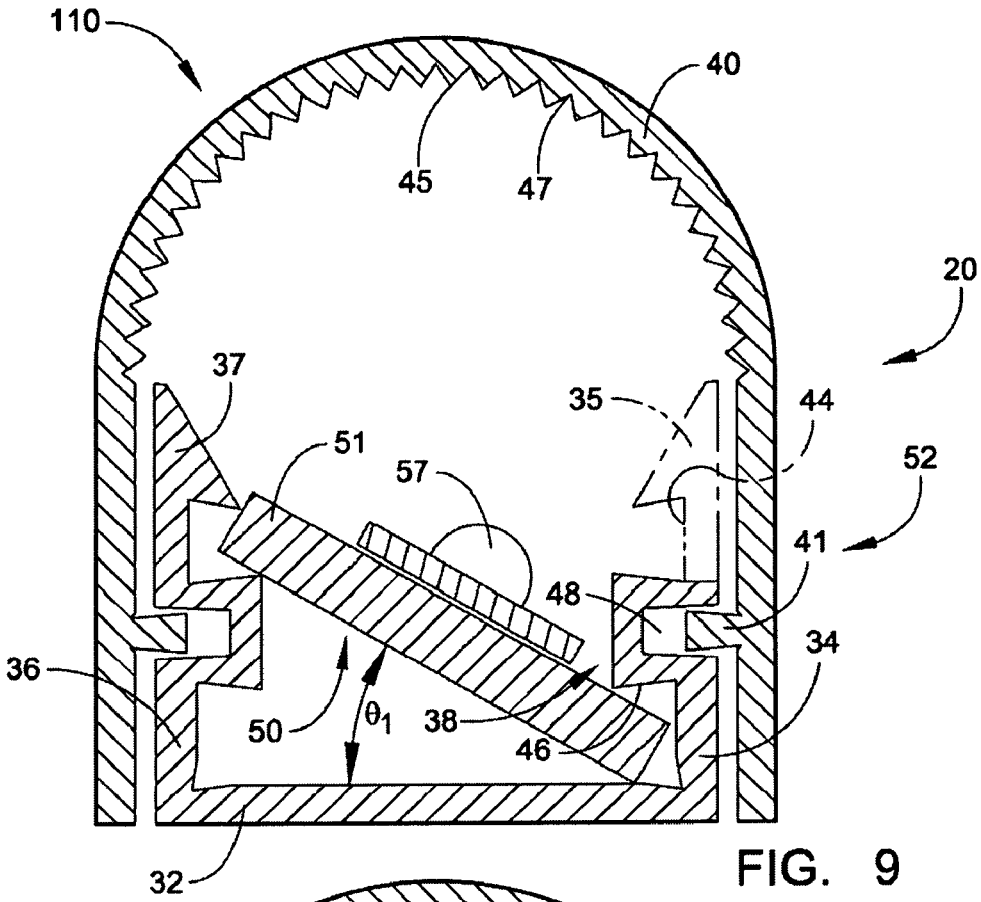
FIG. 9 is a cross sectional view of a light module with a right-side portion of its right-side wall removed.
Figure 10:
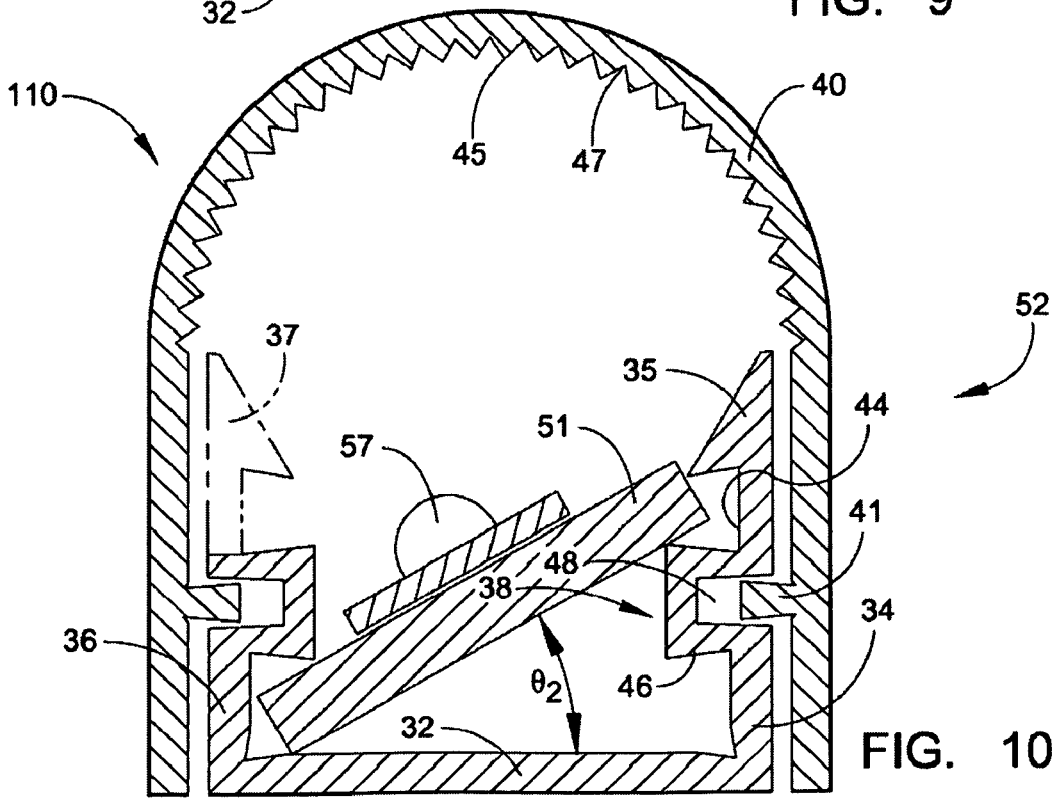
FIG. 10 is a cross sectional view of a light module with a left-side portion of its left support wall removed.

Referring now to the drawings and more particularly to FIGS. 9-10 there is illustrated another modular lighting system 110 which is constructed in accordance with another preferred embodiment of the present invention. The modular lighting system 110 is constructed to be easily configured for positioning light in a customizing manner. The modular lighting system 110 casts visible radiant energy in at least one direction to render objects in that direction visible and more particularly it creates lighting patterns on an object to be illuminated.

Considering now the modular lighting system 110 in greater detail, the lighting system 110 is substantially similar to the lighting system 10 except that it has the ability to be field modified to allow light to be channeled either in a direction toward the right-side wall member 34 or toward the left-side wall member 36 without being obstructed by the retention members 35 and 37 respectively. As the modular lighting system 110 is substantially similar to the lighting system 10 it will not be described hereinafter in greater detail. The manner, in which the field modification is achieved however, will be described.

Figure 5:
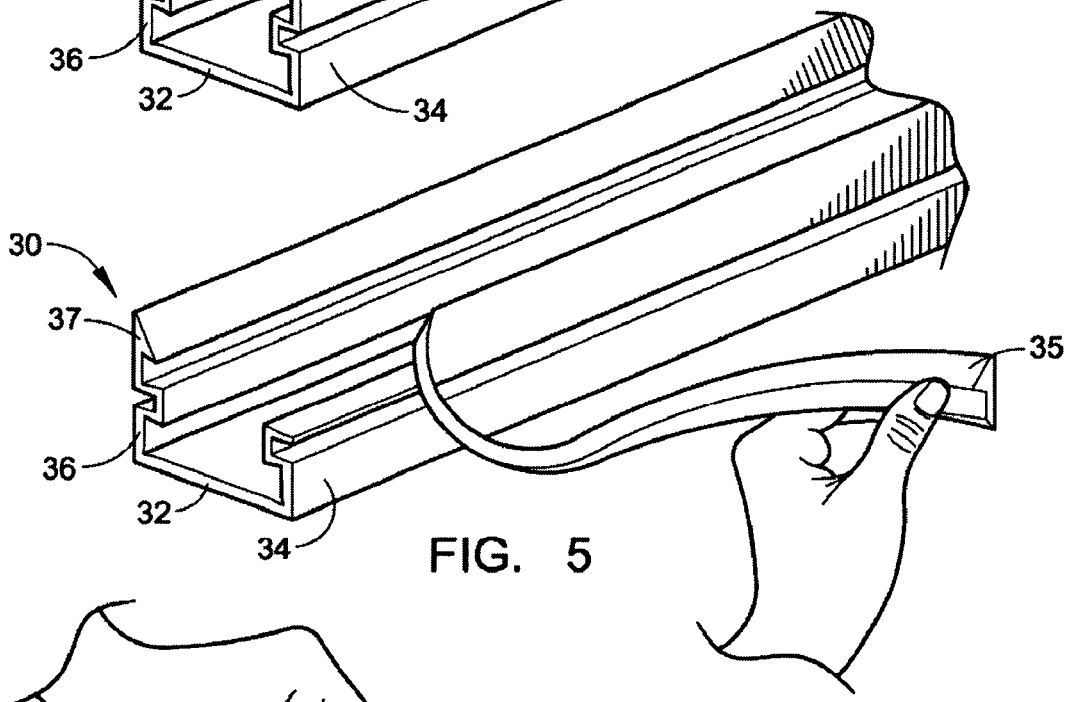
FIG. 5 is a perspective view of the support frame of FIG. 4, illustrating a user removing a right-side portion of its right support wall.

As noted earlier the right-side wall member 34 and the left-side wall member 36 are substantially similar. Therefore only the right-side wall member 34 will be described relative to its field reconfiguration. The right-side wall member 34 at about the boundary between its upper inner wall channel 44 and the retention member 35 is scored either during extrusion or by reason of the channel 44 which extends along the entire longitudinal of the right-side wall member 34. Due to this scored boundary area and the thinness of the right-side wall member 34, a user may easily grasp the retention member 35 and separate and peel it permanently away from the right-side wall member 34 as best seen in FIG. 5. This effectively then removes the upper obstruction of the retention member. As best seen in FIG. 9, a user may then reorient the printed circuit board assembly 50 so that it extends between the base member 32 and the upper inner wall channel on the left-side wall member 36 thereby allowing light to be directed upwardly and to the right without obstruction from the removed retention member 35. From the foregoing, it will be understood by those skilled in the art that the printed circuit board 51 will be inclined upwardly from the base member 32 at about an angle $\theta_1$.

Figure 6:
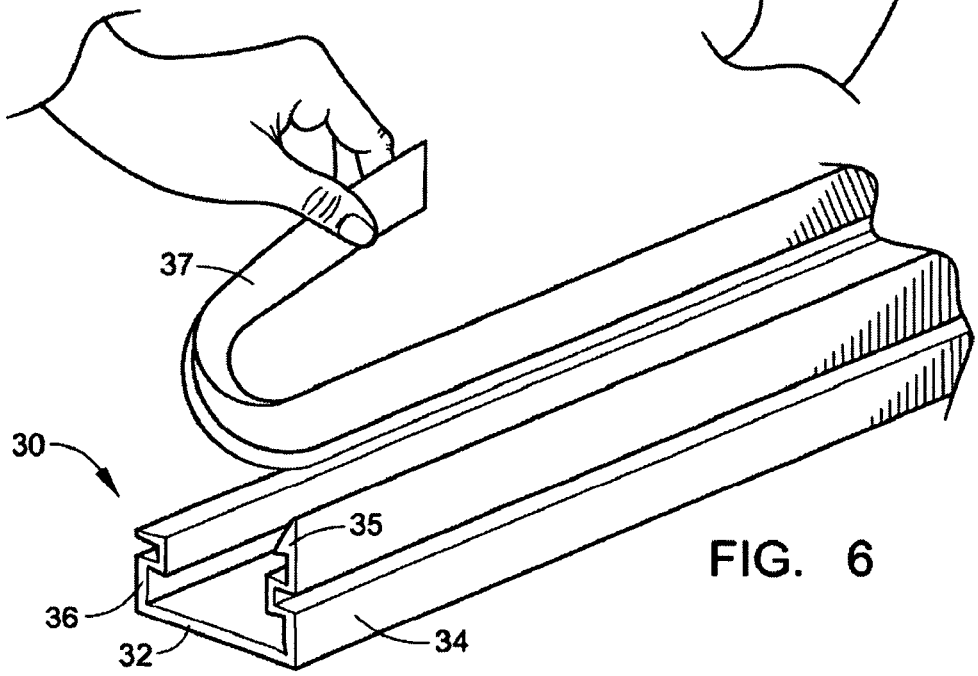
FIG. 6 is a perspective view of the support frame of FIG. 4, illustrating a user removing a left-side portion of its left support wall.

The field operation just described for removing the right retention member 35 can also be executed for the left retention member 37 as best seen in FIG. 6. By removing the left retention member 37, light from the light emitting diodes 57 and 58 can be directed, if needed, upwardly and to the left without obstruction. In this regard, as best seen in FIG. 10, by removal of the retention member 37 and orienting the printed circuit board assembly 50 between the base member 32 and the upper inner channel member 44 disposed on the left-side wall member 36. From the foregoing, it will be understood by those skilled in the art that the printed circuit board 51 will be inclined upwardly from the base member 32 at about an angle $\theta_2$.

In summary then, this tear away lighting system 110 it should be understood by those skilled in the art that one or more printed circuit board assemblies, such as the printed circuit board assembly 50 may be mounted on a field customized or modified support rail, such as the customized support rails illustrated in FIGS. 9 and 10 where the light string is customizable not only in length but also in illumination angles perpendicular to the base wall member 32 or at an angle $\theta_1$ to the right, or at an angle $\theta_2$ to the left.

Figure 12:
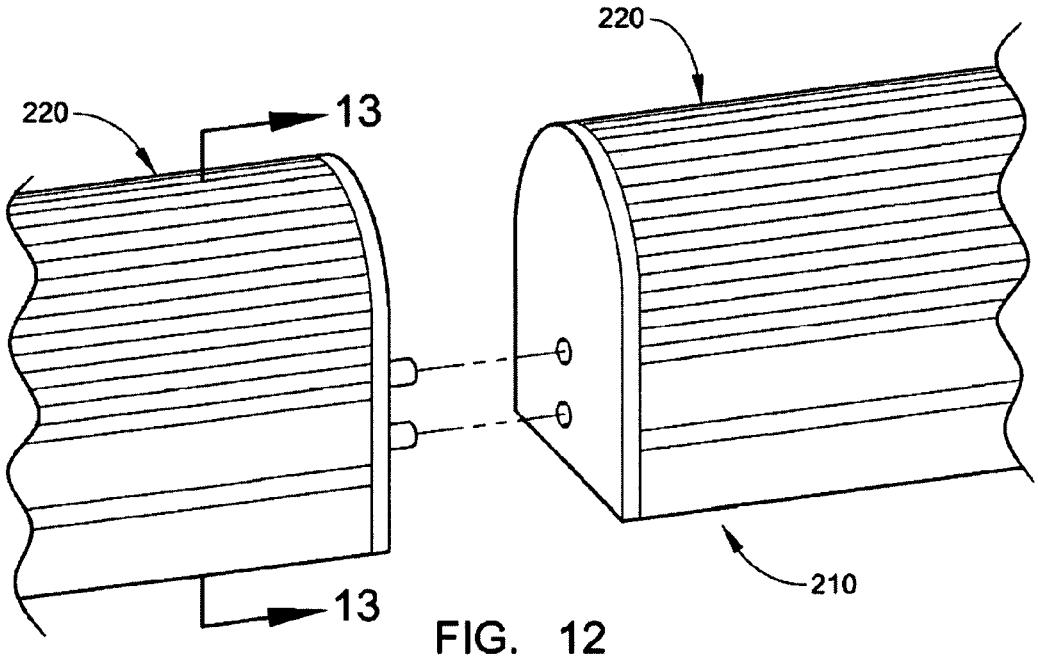
FIG. 12 is an end perspective view of another strip lighting system which is constructed in accordance with the present invention, illustrating its female connecting pins.
Figure 13:
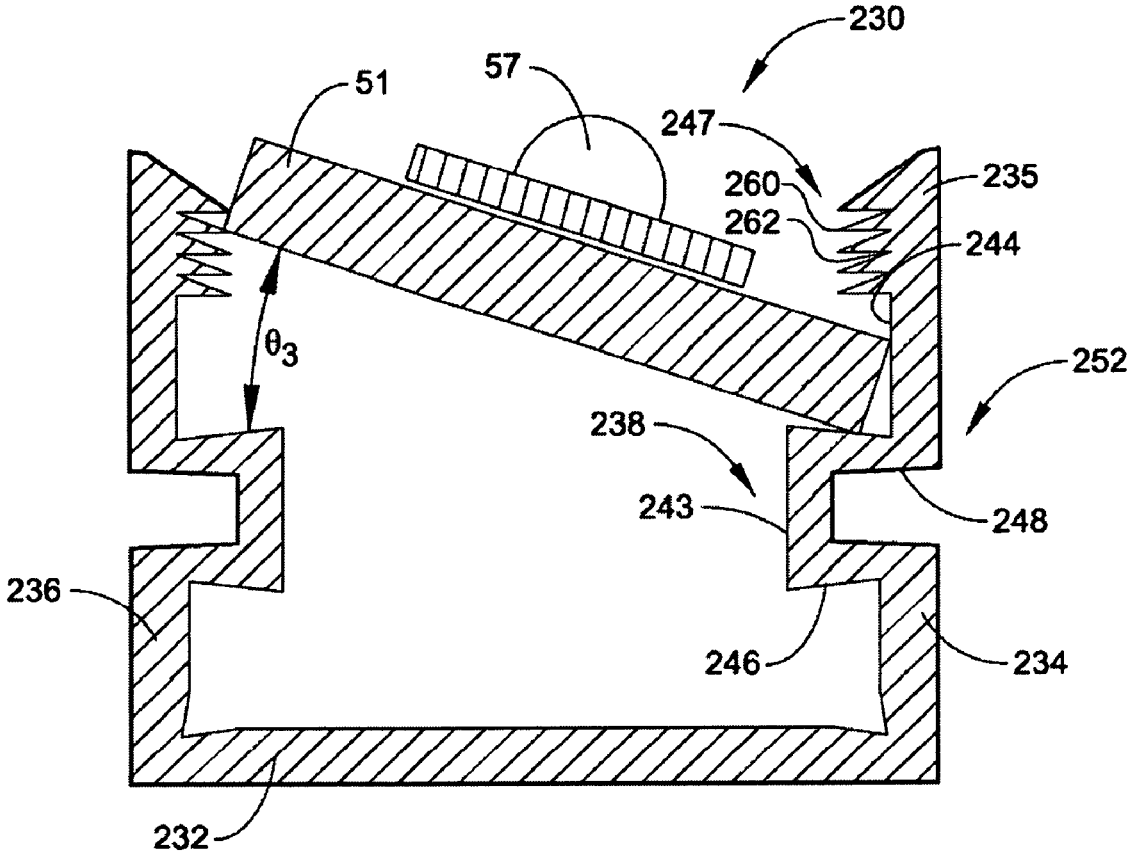
FIG. 13 is a cross sectional view taken substantially along line 13-13 of the light module forming part of the strip lighting system of FIG. 12.
Figure 14A:
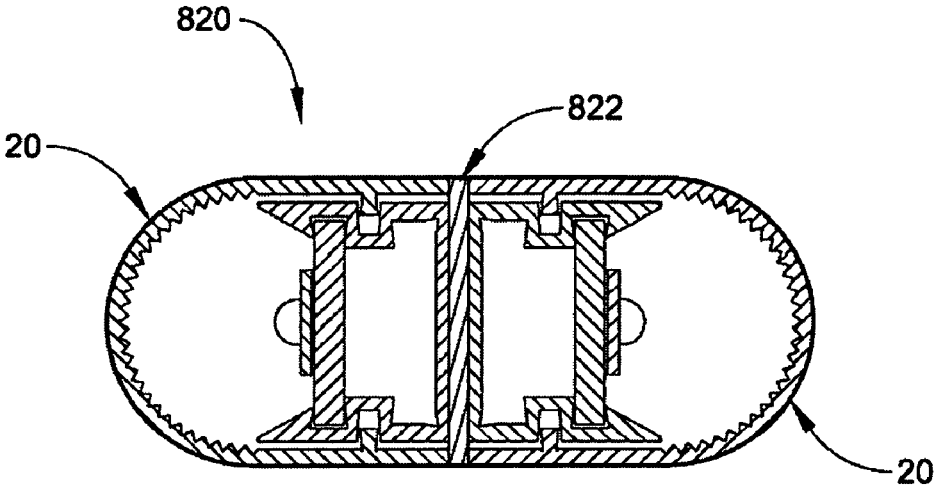
FIGS. 14A-D are cross sectional views of differently configured strip lighting systems which are constructed in accordance with the present invention.
Figure 14B:
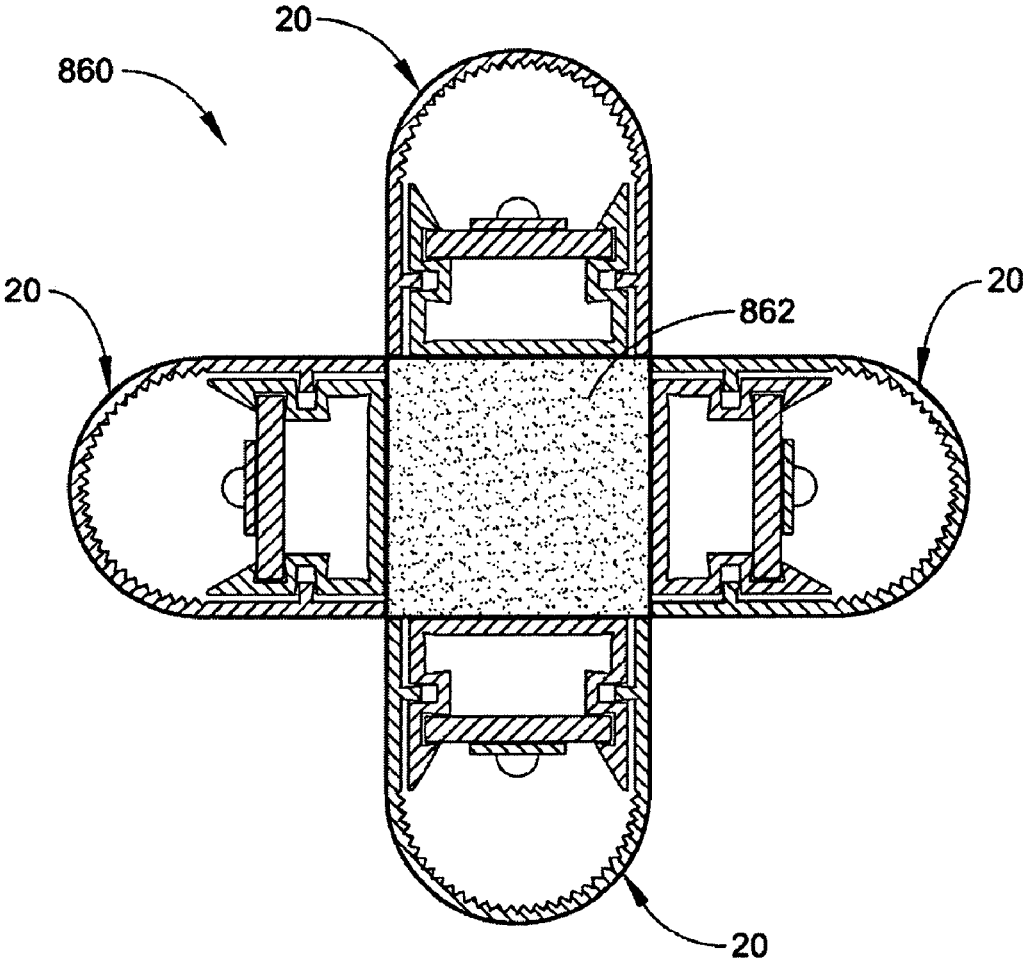
Figure 14C:
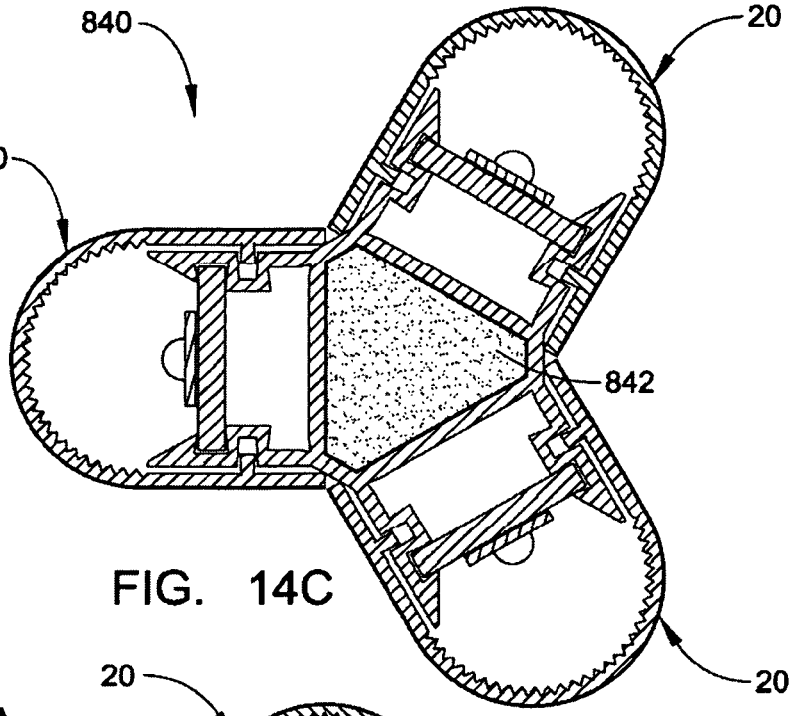
Figure 14D:
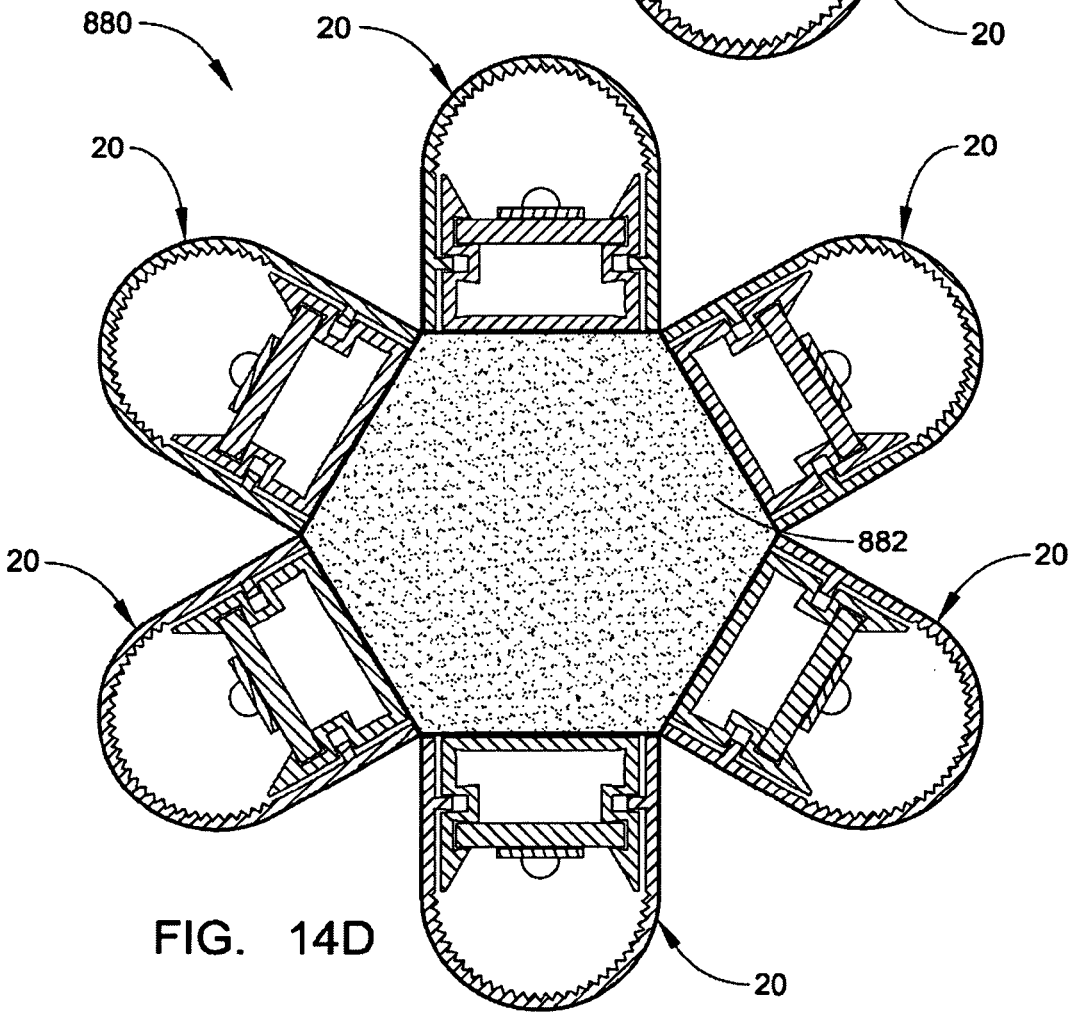

Referring now to the drawings and more particularly to FIGS. 12-13 there is illustrated another modular lighting system 210 which is constructed in accordance with another preferred embodiment of the present invention. The modular lighting system 210 is constructed to be easily configured for positioning light in a customizing manner. The modular lighting system 210 casts visible radiant energy in at least one direction to render objects in that direction visible and more particularly it creates lighting patterns on an object to be illuminated.

Considering now the modular lighting system 210 in greater detail, the lighting system 210 is substantially similar to the lighting system 10 except that it has a different type of retention member construction. As this is the only difference between the two lighting systems 10 and 210, only the retention member construction will be described in greater detail. For clarity purposes reference characters utilized in describing the lighting system 10 will be used and will only be changed as needed for clarity.

Considering now the lighting system 210 in greater detail with reference to FIG. 13, the lighting system 210 includes a one or more light modules, such as a light module 220. Each light module 220 includes a support frame 230 having a base member 232 which is disposed between an upstanding right-side wall member 234 and an upstanding left-side wall member 236. The right-side wall member 234 includes an interior wall surface area indicated generally at 238 and an exterior wall surface area indicated generally at 252. The interior wall area 238 includes an upper inner wall channel 244 and a lower inner wall channel 246 which are separated from one another by a protuberance 243. The outer wall area 252 includes a outer wall channel 248 which is disposed at about the protuberance 243. Integrally connected to the distal end of the right-side wall member 236 is a retention member 235. Integrally connected to the distal end of the left-side wall member 236 is a retention member 237. The right-side wall member 234 and right-side retention member 235 are the mirror image of the left-side wall member 236 and left-side retention member 237. In this regard, since the structure of the right-side retention member 235 is substantially similar to the left-side retention member 237, only the right-side retention member 235 will be described hereinafter in greater detail.

Considering now the right-side retention member 235 in greater detail with reference to FIG. 13, the right-side retention member 235 is generally triangularly shaped and stair stepped with a series 247 of spaced apart ridges and valleys, such as a ridge 260 and a valley 262. The ridges 260 and valleys 262 are constructed to support a bottom edge portion of the printed circuit board 51. In this regard, the ridges comprise a flexible retention function which allow the printed circuit board assembly 50 to be angled directing light straight out when the printed circuit board is extended between the upper inner wall channels or in the alternative to be angled at about an angle $\theta_3$. The angle $\theta_3$ is a variable angle which is dependent upon which one of the stair steps the bottom edge portion of the printed circuit board 51 is supported. In this regards, the angle $\theta_3$ is a configurable angle away from the straight light emission direction. From the foregoing, it should be understood by those skilled in the art, that the printed circuit board assembly 50 may be angled upwardly to the right or to the left using the individual steps on either one of retention members 235 and 237 and the opposing upper interior wall channel area. It should be further understood that the angle $\theta_3$ is between about 0 degrees and about 30 degrees, and that a more preferred angle $\theta_3$ is between about 10 degrees and about 30 degrees, while the most preferred angle % is about 30 degrees.

It should be understood by those skilled in the art, that the retention members 235 and 237 are each constructed of a sufficiently thin plastic material to allow a user to cut and peel away elements of the ridge exposing only the ridges needed to angle the light in a direction needed for installation. This tear way system 210 allows low cost manufacturing, on site configurability, and flexibility to adjust light to match the environment on site. The system 210 is also ultra compact in dimension allowing further advantages over other systems which consume large amount of space in their installation. In short then, the mounting scheme is best embodied as a plastic extrusion to allow the side retention members to be easily cut and peeled and to allow the installation to be cut to length.

As best seen in FIGS. 14A-D, by the use of one or more of a plurality of different types and kinds of module couplers or connectors, linear light arrays with different shapes may be configured. For example, by using an elongated I-shaped module connector 82 an elongate oval shape modular light structure 820 may be configured using at least a pair of light modules 20 to distribute light simultaneously in at least two opposing directions may be formed. Other light distribution patterns such as distributing light in three, four, or six different directions simultaneously may also be configured as best seen in Table I, where Table I provides a partial list of the different types of elongate module connectors and customized elongate modular light structure that may be easily configured in the field by an installer or user as the case may be.

TABLE I

| Type of Module Connector | Number of Light Modules | Resulting Shape |
|---|---|---|
| I shaped (822) | At least two light modules (20) | Oval (820) |
| Triangular shaped (842) | At least three light modules (20) | Three Pin Wheel (840) |
| Rectangularly shaped (862) | At least four light modules (20) | Four Pin Wheel (860) |
| Polygon shaped (882) | At least six light modules (20) | Polygon (880) |

From the foregoing Table I, it should be understood by those skilled in the art, that light may be directed in various angle configurations from zero degrees to three-hundred and sixty degrees in gross and in much finer degree arrangements based upon how the printed circuit board assemblies are mounted within each light modules, such as the light modules 20.

In order to help remove heat from the various types of modular light structure that are configured, each type of modular coupler or connector (82, 84, 86, 88) may be a heat sink type of modular connector.

It is noted that the preferred embodiments of the present invention described herein in detail for exemplary purposes is of course subject to many different variations in structure, design, application and methodology. For example, the support rail system can consist of one single "U" shaped rail with an outside wall track, an inside wall track, and retention members in an extruded shape of two, three, four, or any integer number of linked together mounting ridges facing outwardly from the interior wall area. The extrusion shape can have two, three, four, or other multiple number of mounting ridges on the right-side wall and left-side wall to allow customized angled light installations. The primary innovation therefore is a track system that can be cut to any length on the installation site, and that allows a user to customize the direction of the light between a large number of variable angles. Because many varying and different embodiments may be made within the scope of the inventive concept(s) herein taught, and because many modifications may be made in the embodiments herein detailed in accordance with the description requirements of the law, it is to be understood that the details herein are to be interpreted as illustrative and not in a limiting sense.

PARTS LISTS FOR DESCRIBED ELEMENTS a customizable modular lighting system 10
a lighting module 20
an alternating current to direct current converter 22
an electrical outlet 23
a power cord 24
an adjustable elongate support frame or rail 30
a base member 32
a right-side wall member 34
a retention member 35
a left-side wall member 36
a retention member 37
an inside or interior wall portion or area 38
an elongate track cover 40
a track cover nub or protuberance 41
a male end cap connector 42
an interior wall protuberance 43
an upper inner wall channel 44
a ridge 45
a lower inner wall channel 46
a valley 47
a female end connector 49
an elongate rectangularly shaped printed circuit board assembly 50
a printed circuit board 51
and an outside or exterior wall portion or area 52
a coupling wire 54
a coupling wire 55
a light emitting diode 57
a light emitting diode 58
a plug-in connector pin 62
a plug-in connector pin 64
a diode drive circuit 80
a transistor 81
a 12 volt input source pin 83
a ground pin 84
a resistor 85 (R1)
a diode 86 (D1)
a diode 87 (D2)
an optional resistor 88 (R0)
a resistor 89 (R2)
another modular lighting system 110
another modular lighting system 210
a light module 220
a base member 232
an upstanding right-side wall member 234
a retention member 235
an upstanding left-side wall member 236
a retention member 237
an interior wall surface area 238
a protuberance 243
an upper inner wall channel 244
a lower inner wall channel 246
a series 247 of spaced apart ridges and valleys
an exterior wall surface area 252
a ridge 260
a valley 262
an elongate oval shape modular light structure 820
I shape coupler or heat sink 822
an elongate three pin wheel shape modular light structure 840
Triangular shape coupler or heat sink 842
an elongate four pin wheel shape modular light structure 860
rectangularly shape coupler or heat sink 862
an elongate polygon shape modular light structure 880
polygon shape coupler or heat sink 882

I claim:

1. An adjustable lighting system, comprising:

a support frame having a base member disposed between two upstanding side wall members including a right-side wall member and a left-side wall member;

wherein each side wall member includes an upper inner wall channel, a lower inner wall channel and an outer wall channel disposed between said upper inner wall channel and said lower inner wall channel;

wherein each side wall member further includes at about said upper inner wall channel an integrally connected retention member for facilitating the retention and mounting angle of a printed circuit board having at least one light emitting diode mounted thereon; and wherein each integrally connected retention member includes a plurality of stair-stepped ridges to facilitate establishing an angled light pattern.

2. The adjustable lighting system according to claim 1, wherein the mounting angle of said printed circuit board can be adjusted between a plurality of different angles for directing light emitted by the light emitting diode to create a desired lighting pattern.

3. The adjustable lighting system according to claim 2, wherein said support frame is an elongate rail having a generally U-shape in cross section.

4. The adjustable lighting system according to claim 3, wherein the upper inner wall channel of said right-side wall member and the upper inner wall channel of said left-side-wall member are disposed opposite one another for supporting slidably therebetween said printed circuit board when said desired lighting pattern is a straight light pattern channeled by said side-wall members.

5. The adjustable lighting system according to claim 3, wherein each said side-wall member at about said upper inner wall channel has a sufficiently thin wall thickness to enable a user to remove physically and permanently said integrally connected retention member from said support frame to facilitate supporting said printed circuit board between the upper inner wall channel on one side wall member and the lower inner wall channel on an opposing side wall member.

6. The adjustable lighting system according to claim 5, wherein the an outer wall channel of said right-side wall member and the outer wall channel of said left-side wall member are disposed opposite one another for supporting slidably therebetween a track cover for distributing light emitted from the light emitting diode.

7. The adjustable lighting system according to claim 4, wherein the an outer wall channel of said right-side wall member and the outer wall channel of said left-side wall member are disposed opposite one another for supporting slidably therebetween a track cover for distributing light emitted from the light emitting diode.

8. The adjustable lighting system according to claim 5, wherein the an outer wall channel of said right-side wall member and the outer wall channel of said left-side wall member are disposed opposite one another for supporting slidably therebetween a track cover for distributing light emitted from the light emitting diode.

9. The adjustable lighting system according to claim 6, wherein said track cover is a light modifier.

10. The adjustable lighting system according to claim 1, wherein the individual ones of said plurality of stair-stepped ridges have a sufficient length dimension and a sufficient depth dimension to support thereon a side edge portion of said printed circuit board.

11. The adjustable lighting system according to claim 1, wherein said printed circuit board has extending therefrom a pair of input conductor wires and a pair of output conductor wires;

wherein said pair of input conductors terminate in an input connector mounted at one end of said support frame; and wherein said pair of output conductors terminate in an output connector mounted at another end of said support frame.

12. The adjustable lighting system according to claim 11, wherein in said input connector is a female connector and wherein said output connector is a male connector; and wherein said female connector and said male connector facilitate stringing a plurality of light emitting diodes electrically together to form a linear array.

13. The adjustable lighting system according to claim 11, wherein in said input connector is a male connector and wherein said output connector is a female connector; and wherein said female connector and said male connector facilitate stringing a plurality of light emitting diodes electrically together to form a linear array.

* * * * *